US005797762A

United States Patent [19]

Saito et al.

[11] Patent Number: 5,797,762

[45] Date of Patent: Aug. 25, 1998

[54] ELECTRICAL CONNECTOR HAVING A CAM ACTUATOR FOR A PLURALITY OF CONTACTS

[75] Inventors: Kazuki Saito; Yuichi Matsuno; Yuuji Kuramitsu; Hiroyuki Tsuzuki, all of Tokyo, Japan

[73] Assignees: Japan Aviation Electronics Industry Limited; NEC Corporation, both of Tokyo, Japan

[21] Appl. No.: 734,401

[22] Filed: Oct. 16, 1996

[30] Foreign Application Priority Data

Oct. 19, 1995 [JP] Japan ..... 7-271397

[51] Int. Cl.[6] ..... H01R 4/50

[52] U.S. Cl. ..... 439/342; 439/261

[58] Field of Search ..... 439/342, 259–268

[56] References Cited

U.S. PATENT DOCUMENTS

| | | | |
|---|---|---|---|
| 3,676,832 | 7/1972 | Judge et al. | 439/342 |
| 4,059,323 | 11/1977 | Babuka et al. | 439/342 |
| 4,420,205 | 12/1983 | Kirkman | 439/342 |
| 4,950,980 | 8/1990 | Pfaff | 439/342 |
| 5,065,941 | 11/1991 | Suzuki et al. | 439/342 |
| 5,562,474 | 10/1996 | Lee | 439/342 |

*Primary Examiner*—Hien Vu

*Attorney, Agent, or Firm*—Laff, Whitesel, Conte & Saret, Ltd.

[57] ABSTRACT

In a mechanism for driving a plurality of pin contacts of an edge connector of a memory card assembly in a lateral direction from positions adjacent to socket contacts to bring the pin contacts into contact with the socket contacts of a card receiving connector, the mechanism comprises a pin driving plate having a cam hole and pin contact receiving holes and laterally slidably mounted on the card receiving connector. An actuator rod is removably and rotatably mounted in the card receiving connector and is provided with an eccentric pin portion engaging with the cam hole so that the pin driving plate is laterally driven by engagement between the cam hole and the eccentric pin portion when the actuator rod is rotated. Thus, the pin contacts received in the pin contact receiving holes are brought into contact with the socket contacts. An actuator attachment preventing mechanism is provided for preventing the actuator rod from being inserted to the cam hole unless the memory card assembly is correctively fitted to the card receiving connector. A lock mechanism is further provided for locking the memory card assembly and the card receiving connector in a connected state.

10 Claims, 11 Drawing Sheets

ELECTRICAL CONNECTOR HAVING A CAM ACTUATOR FOR A PLURALITY OF CONTACTS

BACKGROUND OF THE INVENTION

This invention relates to an electrical connector having a cam actuator for a plurality of contacts. Socket contacts and pin contacts of the connector are numerously provided at a back plate (mother board) and a memory card (daughter board), respectively. This invention is suitable to an electrical connector for such a supercomputer having approximately five thousand contacts which are difficult to insert and pull out by manual handling.

Conventional electrical connectors having a cam actuator for a plurality of contacts are disclosed in, for example, U.S. Pat. Nos. 4,059,323 and 3,676,832.

The former conventional electrical connector provides an apparatus for simultaneously interconnecting a plurality of first mating member means (pin contacts) with a plurality of second mating member means (socket contacts) in mutually exclusive pairs. The apparatus has first assembly means for supporting a plurality of the first member means in a predetermined array. Second assembly means supports the second member means in a corresponding array. The first and the second assembly means are juxtaposed with respect to each other to provide relative linear motion therebetween. A cam means effects the linear motion in a bidirectional manner in response to a rotational force applied thereto about a predetermined axis of rotation. The rotational force is applied in a given direction about the axis between first and second predetermined angular positions to provide the linear motion in a first linear direction to effect the interconnecting of a plurality of the first and the second mating member means. The rotational force is further applied in the given direction about the axis between the second angular position and a third predetermined angular position to provide the relative linear motion in an opposite second linear direction to relieve undesirable stresses when present in the apparatus caused by interconnecting a plurality of the first and the second member means.

In the former conventional electrical connector having the cam means for a plurality of the pin contacts and socket contacts, when the cam means rotates in a direction, the first assembly means moves in a direction to the second assembly means. Therefore, the pin contacts provided at the first assembly means are inserted into the socket contacts provided at the second assembly means. When the cam means rotates in the other direction, the first assembly means moves in the other direction to the second assembly means. Consequently, the pin contacts are pulled out from the socket contacts.

It should, however, be noted that the former conventional electrical connector having the cam means has a complicated structure, many parts, and a fixed cam means structure to the connector. This renders the electrical connector unreliable, bulky, and expensive.

The latter conventional electrical connector is similar to the former one in the essential point.

SUMMARY OF THE INVENTION

It is therefore an object of this invention to provide an electrical connector with a reliable structure.

It is another object of this invention to provide an electrical connector with a simple and inexpensive structure.

It is still another object of this invention to provide an electrical connector with a detachable cam structure to the electrical connector.

It is yet another object of this invention to provide an electrical connector with various functions.

Other objects of this invention will become clear as the description proceeds.

According to this invention, there is provided an electrical connector having a cam actuator for a plurality of contacts. The electrical connector comprises: a first assembly having a plurality of pin contacts fixedly supported on and extending from a first plane of a first insulator; a second assembly having a plurality of socket contacts to be brought into connection to said pin contacts, said socket contacts being fixedly supported in a second insulator and outwardly exposed in a second plane of said second insulator, said second plane being faced to said first plane when said pin contacts are brought into contact with said socket contacts, respectively; pin driving plate mounted on said second plane and having a plurality of pin receiving holes extending in a first direction perpendicular to said second plane for receiving said pin contacts upon connection to said socket contacts, said pin driving plate being reciprocatingly movable along said second plane and in a second direction perpendicular to said first direction for driving said pin contacts in said second direction for connection and disconnection between said pin contacts and said socket contacts, said pin driving plate having a cam hole; and an actuator member removably attached to said second assembly and having a cam portion engaged with said cam hole for actuating said pin driving plate in said second direction.

DESCRIPTION OF THE PREFERRED EMBODIMENT:

Referring to FIGS. 1 to 15, the description will proceed to an electrical connector having a cam actuator for a plurality of contacts according to a preferred embodiment of this invention.

At first, the description will proceed to the cam actuator of the electrical connector, referring to FIGS. 1 to 11.

Figure 1:
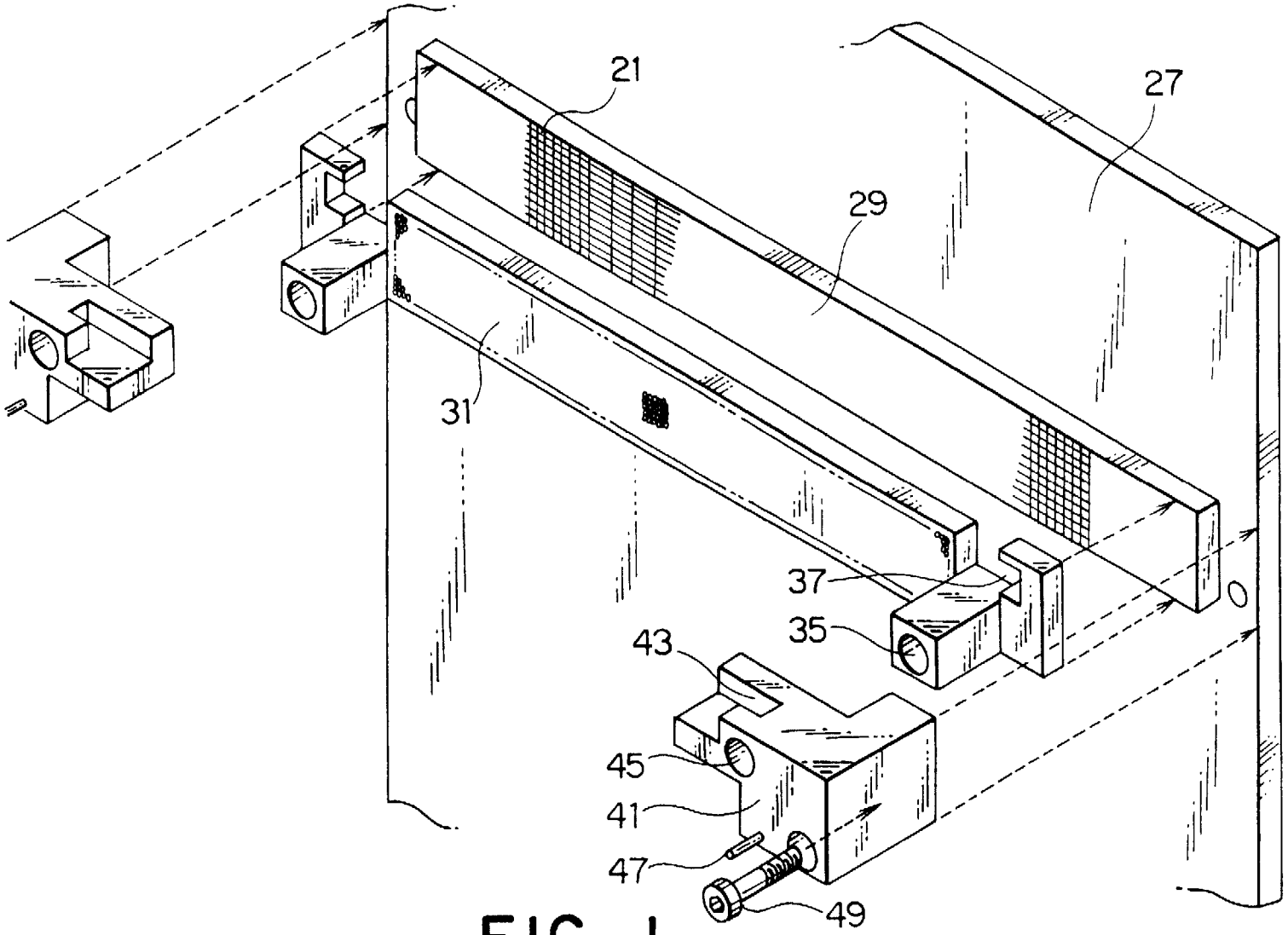
FIG. 1 is an exploded perspective view of an electrical connector on a back plate side according to an embodiment of this invention.
Figure 2:
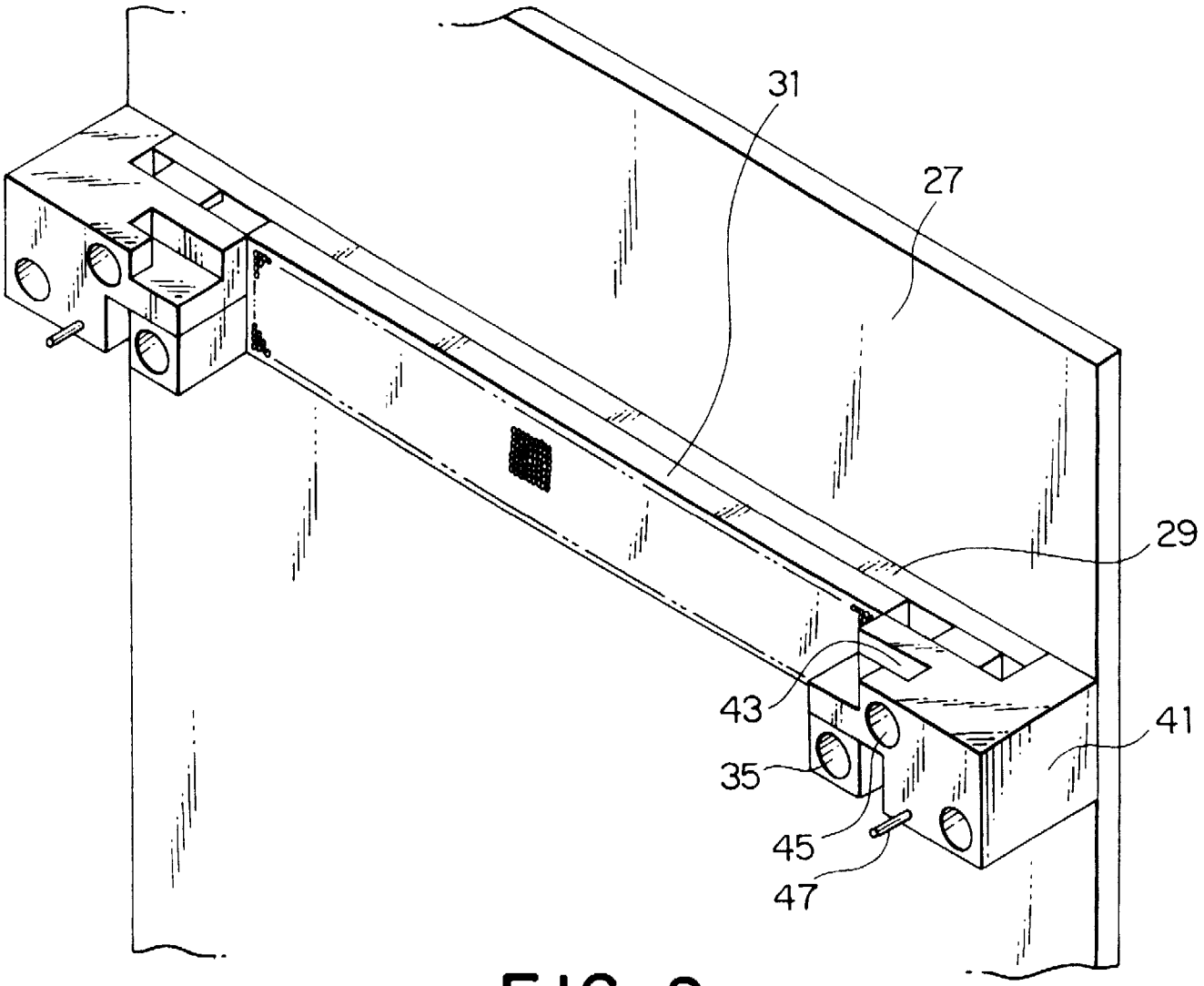
FIG. 2 is a perspective view in completed assembling of the electrical connector on the back plate side according to the embodiment of this invention.

In FIG. 1 as a second assembly, a plurality of socket contacts 21 are fixed at a back plate 27 as a part of a second insulator by press fit. The socket contacts 21 are covered with a housing plate 29 as another part of the second insulator which is mounted on the back plate 27. The housing plate 29 is covered with a pin driving plate 31 which has a pair of holes 35, a pair of cam holes 37, and dummy pins (preload pins) 39 (see FIGS. 5, 7, etc.). The pin driving plate 31 can move to the right and left directions in this state. When a pair of guide blocks 41 as another part of the second insulator which has a built-in detective mechanism for insertion of a memory card is fixed at the back plate 27 by means of screws 49 respectively, the pin driving plate 31 is not detachable from the housing plate 29. But the pin driving plate 31 can move to the right and left directions by a rod 65 as an actuator member having an eccentric portion 66 (see FIGS. 7, 8, and 9).

Figure 3:
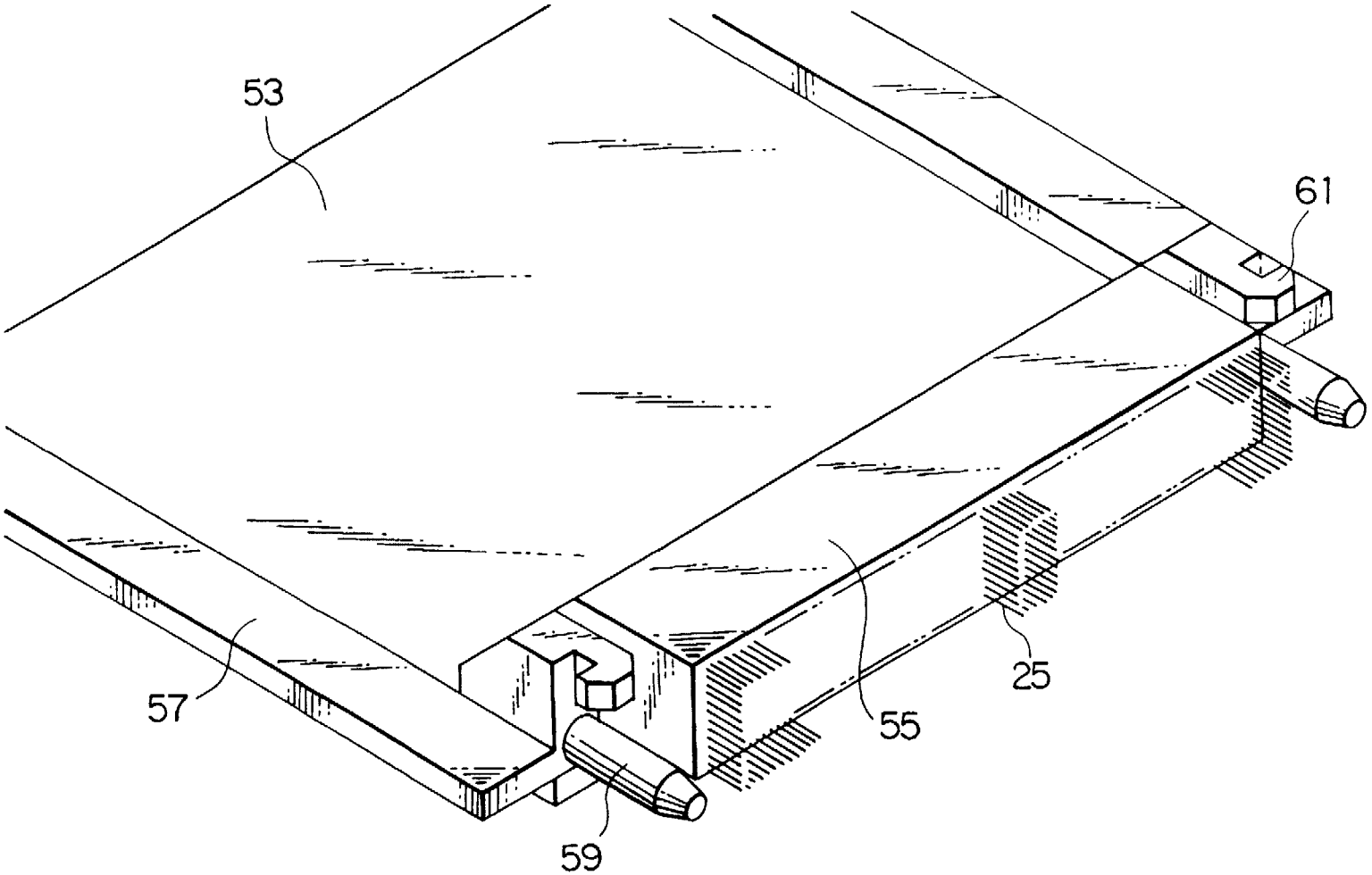
FIG. 3 is a perspective view of the electrical connector on a memory card side according to the embodiment of this invention.

In FIG. 3 as a first assembly and a memory card assembly, an edge connector 55 as a first insulator having a plurality of pin contacts is mounted on a memory card 53. The edge connector 55 is connected to the memory card 53 by means of soldering, press fit, etc. A pair of side plates 57 each of which has a guide pin 59 and a lock key 61 are fixed on both sides of the memory card 53, respectively.

Figure 4:
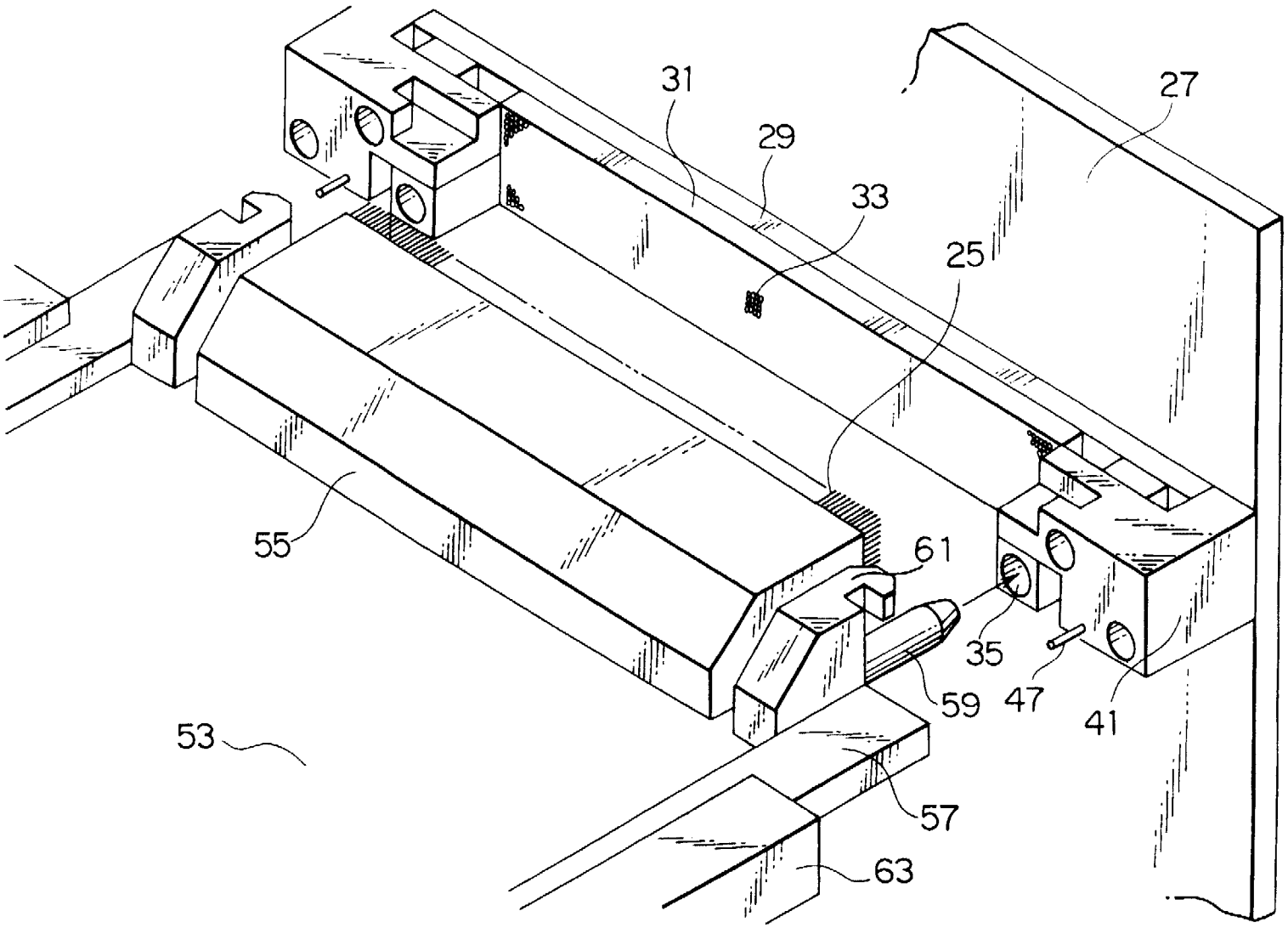
FIG. 4 is a perspective view of the electrical connector in a state before insertion of the memory card according to the embodiment of this invention.

In FIG. 4, a pair of side plates 57 which are fixed on both sides of the memory card 53 are guided along a pair of guide rails 63. A pair of guide pins 59 are inserted into a pair of holes 35 firstly. Plural pin contacts 25 are inserted into the predetermined position at the housing plate 29 through a plurality of pin receiving holes 33 provided in the pin driving plate 31 secondly.

Figure 5:
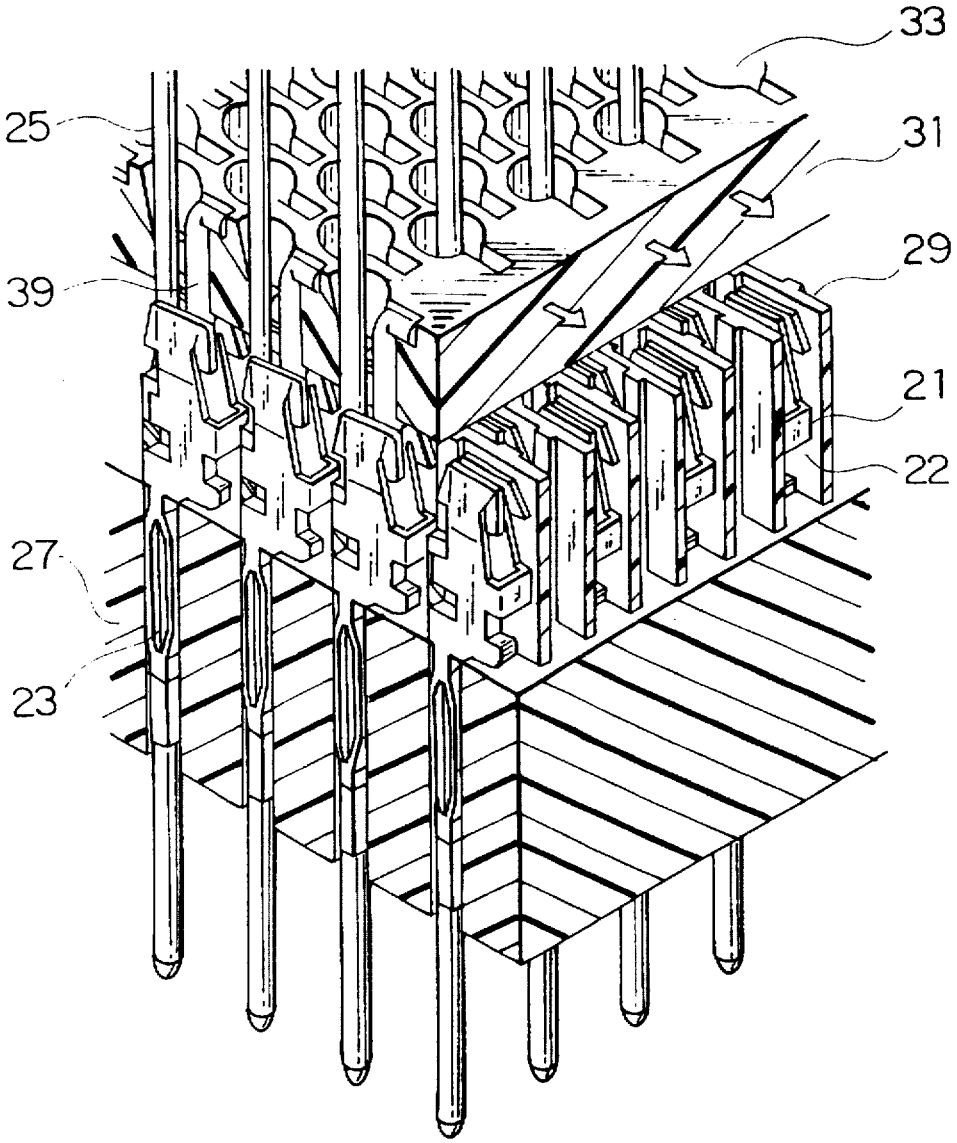
FIG. 5 is an enlarged perspective view of a portion of contacts of the electrical connector according to the embodiment of this invention.

FIG. 5 shows an enlarged perspective view on the above-mentioned state. The housing plate 29 has socket contacts holes 22 in which socket portions of the socket contacts 21 are contained. Plural pin contacts 25 have not yet been inserted into the socket contacts 21 at this moment. The socket contacts 21 are installed to the back plate 27 at their portions 23 for press fit.

Figure 6:
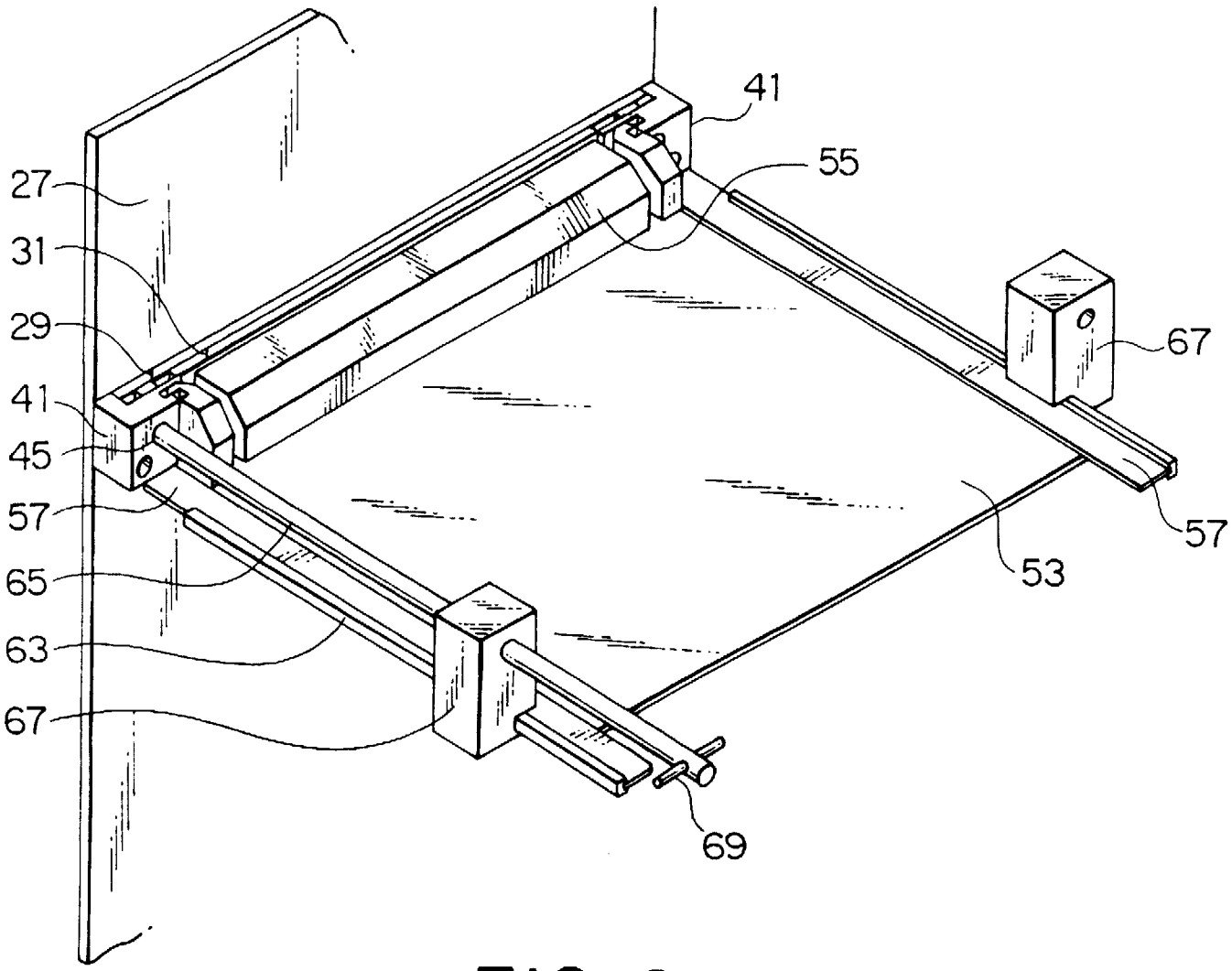
FIG. 6 is a perspective view of the electrical connector in a state after insertion of the memory card according to the embodiment of this invention.

After the memory card 53 has been surely inserted into the predetermined position as shown in FIG. 6, the rod 65 is inserted into a rod receiving hole 45 bored at the left guide block 41 through a supporting block 67. A pair of the supporting blocks 67 are fixed at a casing (not shown).

Figure 7:
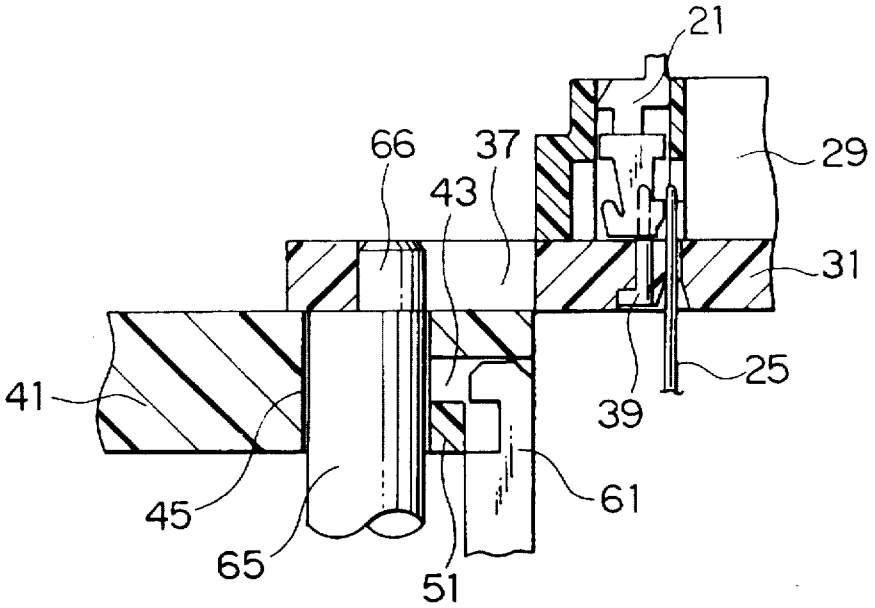
FIG. 7 is a sectional view of a card locking mechanism with an imperfect locking preventive mechanism of the electrical connector in a state just before locking according to the embodiment of this invention.

In FIG. 7, the eccentric portion 66 of the rod 65 is inserted into and engaged with the cam hole 37 bored at the pin driving plate 31 through the rod receiving hole 45 bored at the guide block 41. The pin contacts 25 have not yet been inserted into the socket contacts 21 at this moment.

Figure 8:
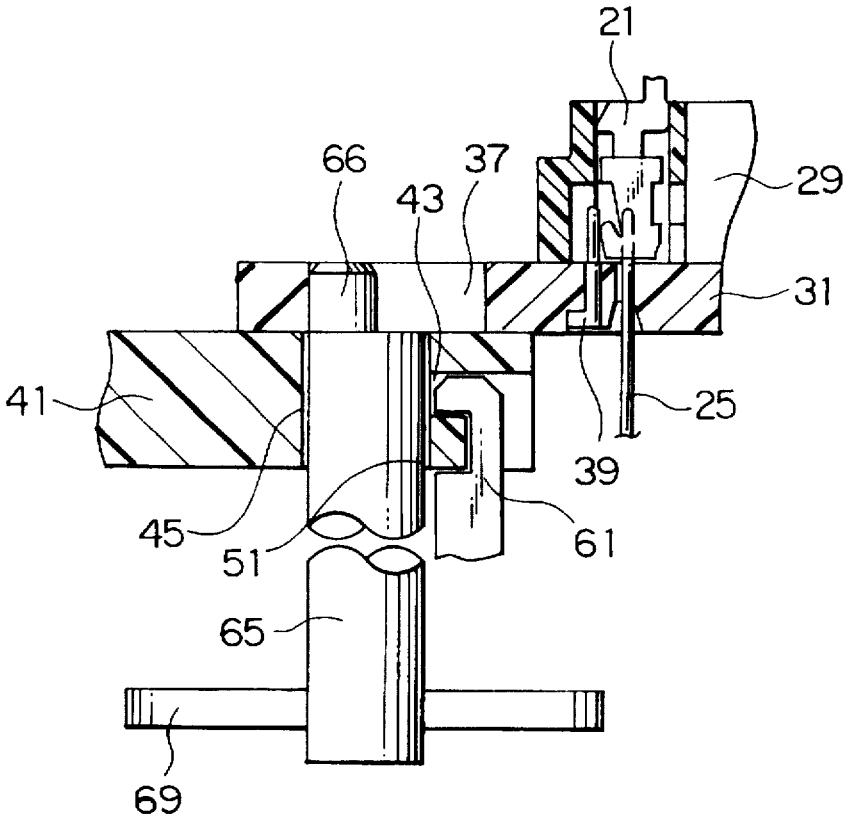
FIG. 8 is a sectional view of the card locking mechanism with the imperfect locking preventive mechanism of the electrical connector in a locking state according to the embodiment of this invention.
Figure 9:
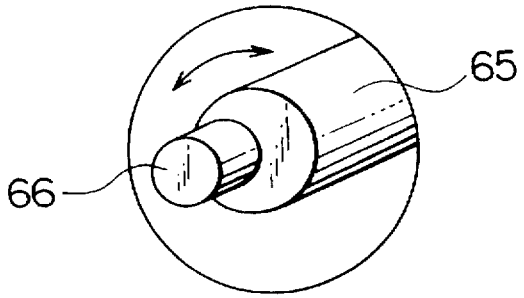
FIG. 9 is a perspective view of an end portion of a cam in the electrical connector according to the embodiment of this invention.

When the rod 65 is made a half rotation by operation of a handle 69 fixed to the rod 65, the pin driving plate 31 moves to the left side by operation of the eccentric portion 66, as shown in FIG. 8. Thereupon the pin contacts 25 are inserted into the socket contacts 21. A pair of the guide blocks 41 are fixed to the back plate 27, and a central axis of the rod receiving hole 45 bored at the guide block 41 becomes a rotating axis of the rod 65 on this occasion.

Figure 10:
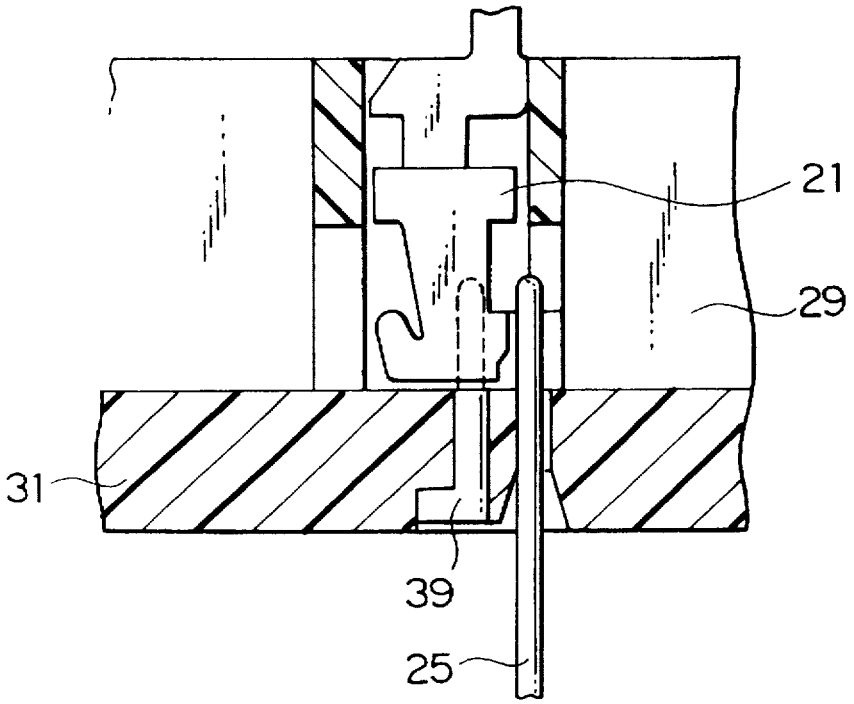
FIG. 10 is an enlarged sectional view of the portion of the contacts of the electrical connector in a state before connection according to the embodiment of this invention.

FIG. 10 shows a state in which the pin contacts 25 do not yet touch to the socket contacts 21.

Figure 11:
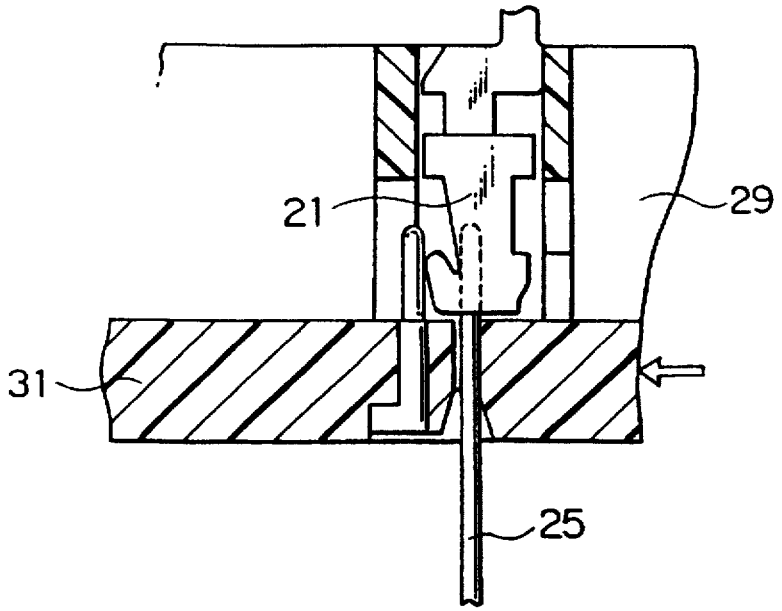
FIG. 11 is an enlarged sectional view of the portion of the contacts of the electrical connector in a state after connection according to the embodiment of this invention.

FIG. 11 shows a state in which the pin contacts 25 have already touched to the socket contacts 21.

Figure 12:
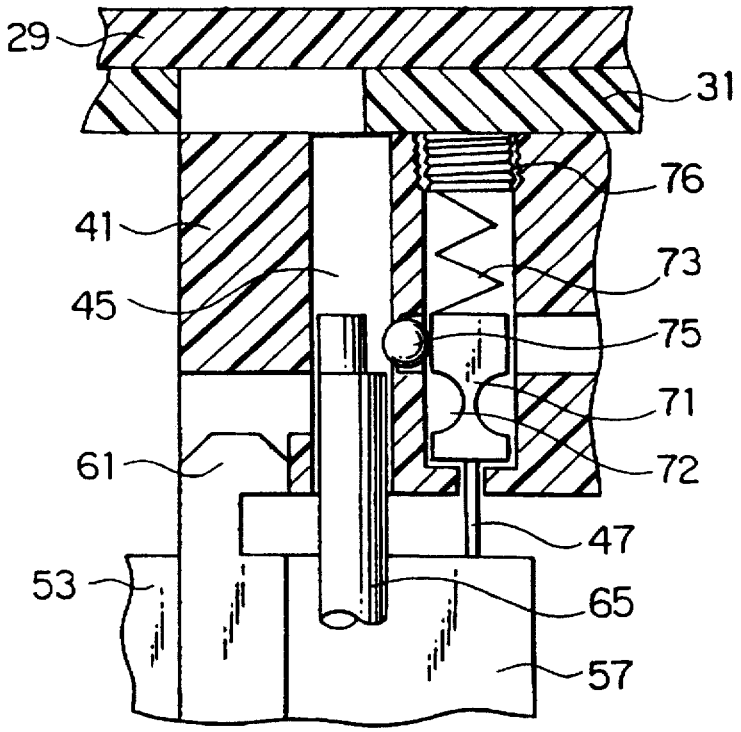
FIG. 12 is a sectional view of a detective mechanism for insertion of the memory card of the electrical connector in a state before insertion according to the embodiment of this invention.
Figure 13:
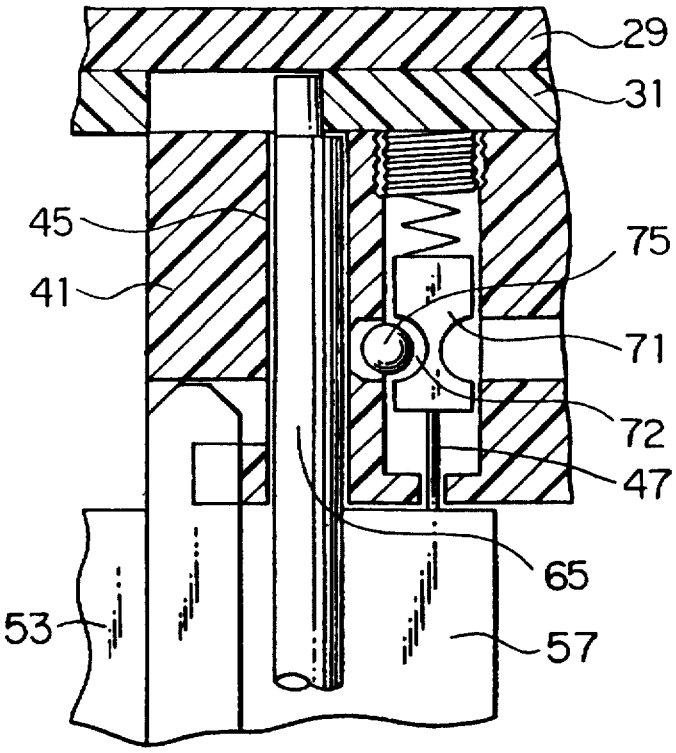
FIG. 13 is a sectional view of the detective mechanism for insertion of the memory card in a state after insertion according to the embodiment of this invention.

Next, the description will proceed to a detective mechanism for insertion of a memory card of the electrical connector, referring to FIGS. 12 and 13.

In FIG. 12, the guide blocks 41 contains a slider 71 having a detective pin 47 for insertion of the memory card 53 and a concaveness 72, a compression spring 73 pressing the slider 71, and a ball 75 having free access to the concaveness 72. An end of the compression spring 73 is fixed to a screw 76. The slider 71 which is supported in the guide blocks 41 is removable between a forward position shown in FIG. 12 and a rearward position shown in FIG. 13. The ball 75 which is supported in the guide blocks 41 is partially projected into the rod receiving hole 45 by the slider 71, when the slider 71 is at the forward position shown in FIG. 12 so as to prevent the rod 65 from being inserted into the rod receiving hole 45. As the memory card 53 has not yet been inserted into the electrical connector completely, the detective pin 47 has not yet escaped into the guide blocks 41. Consequently, the ball 75 obstructs the rod 65 which is going to be inserted into the rod receiving hole 45 bored at the guide block 41.

When the memory card 53 is inserted into the electrical connector, the detective pin 47 compresses the compression spring 73 through the slider 71, and the concaveness 72 of the slider 71 moves to the rearward position shown in FIG. 13. Thereupon the rod 65 pushes the ball 75 into the concaveness 72 of the slider 71, and enters into the rod receiving hole 45. Namely, when the memory card 53 is completely inserted into the electrical connector, the eccentric portion 66 of the rod 65 can move the pin driving plate 31. However, when the memory card 53 is incompletely inserted into the electrical connector, the eccentric portion 66 of the rod 65 can not move the pin driving plate 31.

Further, the description will proceed to a memory card locking mechanism with an imperfect locking preventive mechanism of the electrical connector.

In FIG. 8, the lock key 61 which is provided at the side plate 57 fixed to the memory card 53 stays in a groove 43 provided at the guide blocks 41. The memory card 53 can not break away from the back plate 27 after movement of the pin driving plate 31. When the memory card 53 is incompletely inserted into the electrical connector, even if the eccentric portion 66 of the rod 65 can move the pin driving plate 31, the lock key 61 can not enter into the groove 43 because the lock key 61 collides with a projection 51 provided at the guide blocks 41. Therefore, imperfect locking of the memory card 53 is prevented.

Furthermore, the description will proceed to a memory card locking mechanism of the electrical connector.

Figure 14:
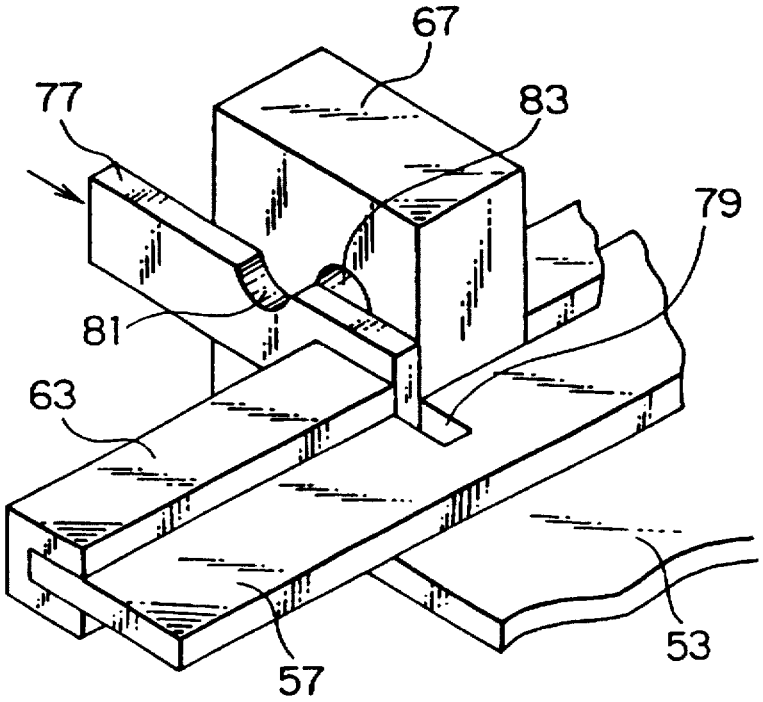
FIG. 14 is a perspective view of an additional card locking mechanism of the electrical connector in a state before locking according to the embodiment of this invention.
Figure 15:
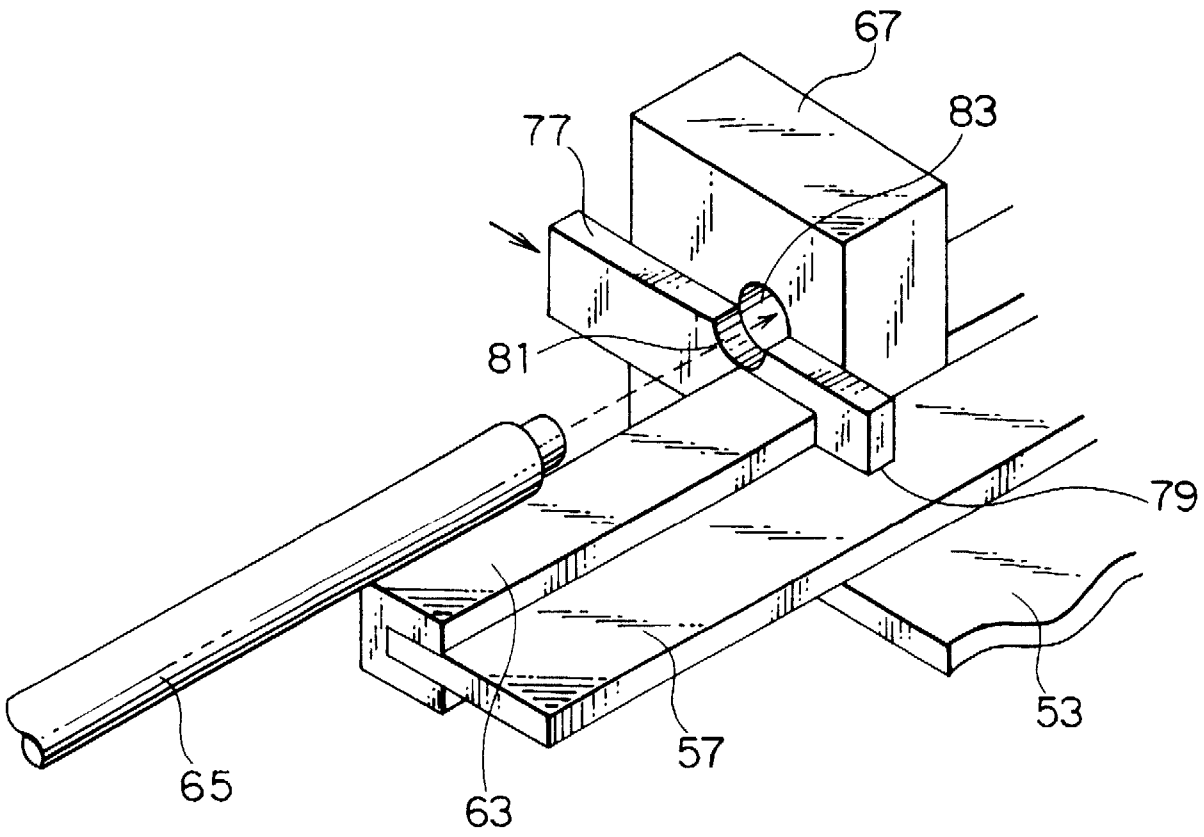
FIG. 15 is a perspective view of the additional card locking mechanism of the electrical connector in a state after locking according to the embodiment of this invention.

At a state shown in FIG. 14, when a lock lever 77 provided at a supporting block 67 is pushed to an arrow direction indicated by a solid line, the lock lever 77 moves to a state shown in FIG. 15. As an end of the lock lever 77 enters into a lock lever groove 79 formed at the side plate 5 7, the memory card 53 is locked. A semicircular hole 81 bored at the lock lever 77 agrees with a circular hole 83 bored the supporting block 67 at this moment. Therefore, the rod 65 can pass through the supporting block 67 in an arrow direction indicated by a broken line. In other words, the fact that the rod 65 has passed through in the supporting block 67 proves the memory card 53 has been locked.

In FIG. 6, in case of ejection of the memory card 53, the rod 65 is detached from the left guide block 41, and is inserted to the right guide block 41. When the eccentric portion 66 of the rod 65 moves the pin driving plate 31 to the right, the pin contacts 25 break away from the socket contacts 21. When the lock lever 77 is pulled out to an opposite arrow direction indicated by a solid line in FIG. 15, the end of the lock lever 77 escapes from the groove 79 formed at the side plate 57. Consequently, the memory card 53 is capable of ejection.

The above-mentioned embodiment of this invention is capable of modification as follows. Namely, the pin driving plate 31 is always pressed to the eccentric portion 66 of the rod 65 by means of a spring (not shown). In case of ejection of the memory card 53, the rod 65 is made a half rotation to the same or opposite direction aforementioned. Thereupon the pin driving plate 31 returns to the beginning position. Consequently, the rod 65 need not need be detached from the left guide block 41 and then to be inserted into the right guide block 41.

What is claimed is:

1. An electrical connector comprising:

a first assembly having a plurality of pin contacts fixedly supported on and extending from a first plane of a first insulator and being a memory card assembly which comprises:

a memory card; and an edge connector mounted on said memory card and at an edge portion of said memory card, said edge connector comprising said first insulator and said pin contracts;

a second assembly having a plurality of socket contacts configured to be brought into a connection with said pin contacts, said socket contacts being fixedly supported in a second insulator having a rod receiving hole for removably and rotatably supporting a rod and being outwardly exposed in a second plane of said second insulator, said second plane facing toward said first plane when said pin contacts are brought into contact with said socket contacts, respectively;

A pin driving plate mounted in said second plane and having a plurality of pin receiving holes extending in a first direction perpendicular to said second plane for receiving said pin contacts upon a connection to said socket contacts, said pin driving plate being reciprocatingly movable along said second plane and in a second direction perpendicular to said first direction for driving said pin contacts in said second direction for making a connection and a disconnection between said pin contacts and said socket contacts, said pin driving plate having a cam hole; and an actuator member removably attached to said second assembly and being said rod having a circular section with an eccentric portion engaged with said cam hole for actuating said pin driving plate in said second direction.

2. An electrical connector as claimed in claim 1, wherein said insulator has a supporting portion covering said cam hole, and said supporting portion is provided with said rod receiving hole, said actuator member is provided with said eccentric portion at an end of said rod.

3. An electrical connector as claimed in claim 2, wherein said actuator member is provided with a handle at an opposite end portion of said rod for rotating said rod.

4. An electrical connector as claimed in claim 1, wherein said memory card assembly has a side plate for supporting said memory card, and said supporting portion includes a mechanism which comprises:

a slider supported in said supporting portion and movable in said first direction between a forward position and a rearward position;

a compression spring pressing said slider into said forward position;

a ball movably supported in said supporting portion, said ball being partially projected into said rod receiving hole by said slider when said slider is at the forward position so as to prevent said rod from being inserted into said rod receiving hole, while said ball is permitted to retire from said rod receiving hole when said slider is at the rearward position; and a detective pin fixed to said slider and protruding from said supporting portion in said first direction when said slider is at the forward position, said detective pin engaging with and being pressed by said side plate to bring said slider to said rearward position when said memory card assembly is brought into said second assembly.

5. An electrical connector as claimed in claim 1, which further comprises a card locking mechanism comprising:

a lock key groove formed in one of said side plate and said supporting portion; and a lock key provided to the other of said sideplate and said supporting portion and permitted to be moved into said lock key groove when said card assembly is completely fitted to said second assembly.

6. An electrical connector as claimed in claim 5, wherein said second insulator comprises:

a back plate supporting said socket contacts with a socket portions protruding therefrom in said first direction;

a housing plate mounted on said back plate and having socket contact holes in which said socket portions are contained; and a pair of guide blocks fixed to said back plate by screws, said guide blocks fixedly supporting said housing plate and movably supporting said pin driving plate, one of said guide block being said supporting portion.

7. An electrical connector as claimed in claim 6, wherein said memory card assembly further comprises an opposite side plate supporting said memory card at an opposite side, and wherein said second assembly further comprises a pair of supporting blocks for guiding said side plate and said opposite side plate, respectively, when said memory card assembly is brought to be fitted to said second assembly.

8. An electrical connector as claimed in claim 7, which further comprises an additional card locking mechanism comprising:

a groove formed in said side plate; and a lock lever movably mounted on one of said supporting blocks and being capable of entering to said lock lever groove so as to lock said memory card assembly.

9. An electrical connector as claimed in claim 8, one of said supporting blocks is provided with a rod passing hole through which said rod can be passed and supported.

10. An electrical connector as claimed in claim 9, wherein said lock lever has a semicircular hole through which said rod can be inserted into said cam passing holes when said lock lever locks said memory card assembly.

* * * * *